United States Patent [19]

Ehrenfeld, Jr. et al.

[11] 4,008,349

[45] Feb. 15, 1977

[54] METHOD FOR CONTINUOUSLY APPLYING A UNIFORM RESINOUS COATING BY PASSING THE SUBSTRATE THROUGH A FREE HANGING LOOP CONTAINING THE COATING COMPOSITION

[75] Inventors: Frank E. Ehrenfeld, Jr., Morrisville, Pa.; Anthony N. Piacente, Lawrenceville, N.J.

[73] Assignee: Congoleum Corporation, Milwaukee, Wis.

[22] Filed: Aug. 28, 1974

[21] Appl. No.: 501,261

[52] U.S. Cl. ..... 428/161; 118/325; 118/419; 427/275; 427/345; 427/346; 427/385 B; 427/424

[51] Int. Cl.[2] ..... B32B 3/00

[58] Field of Search ..... 117/102 L, 105.3, 161 KP; 118/325, 419; 427/420, 331, 424, 345, 275, 346, 385 B

[56] References Cited

UNITED STATES PATENTS

| | | | |
|---|---|---|---|
| 593,896 | 11/1897 | Johnson | 118/325 |
| 828,773 | 8/1906 | Pease | 354/317 |
| 2,961,332 | 11/1960 | Nairn | 161/116 |
| 3,135,711 | 6/1964 | Thoma et al. | 117/161 |
| 3,594,213 | 7/1971 | Rudman | 117/161 |
| 3,642,515 | 2/1972 | Sato et al. | 117/37 |

*Primary Examiner*—Harry J. Gwinnell
*Assistant Examiner*—Sadie L. Childs
*Attorney, Agent, or Firm*—Richard T. Laughlin

[57] ABSTRACT

A method is disclosed for continuously applying a resinous wear-resistance surface of finish coating to a traveling web substrate which comprises moving the web into a free hanging loop, continuously feeding the liquid resin coating composition into the loop at a rate so as to maintain at least a slight overflow of the composition at the sides of the loop, withdrawing the web upwardly from the loop with a thin coating of the resin applied thereto, and then heating the coated web for drying the coating.

20 Claims, 1 Drawing Figure

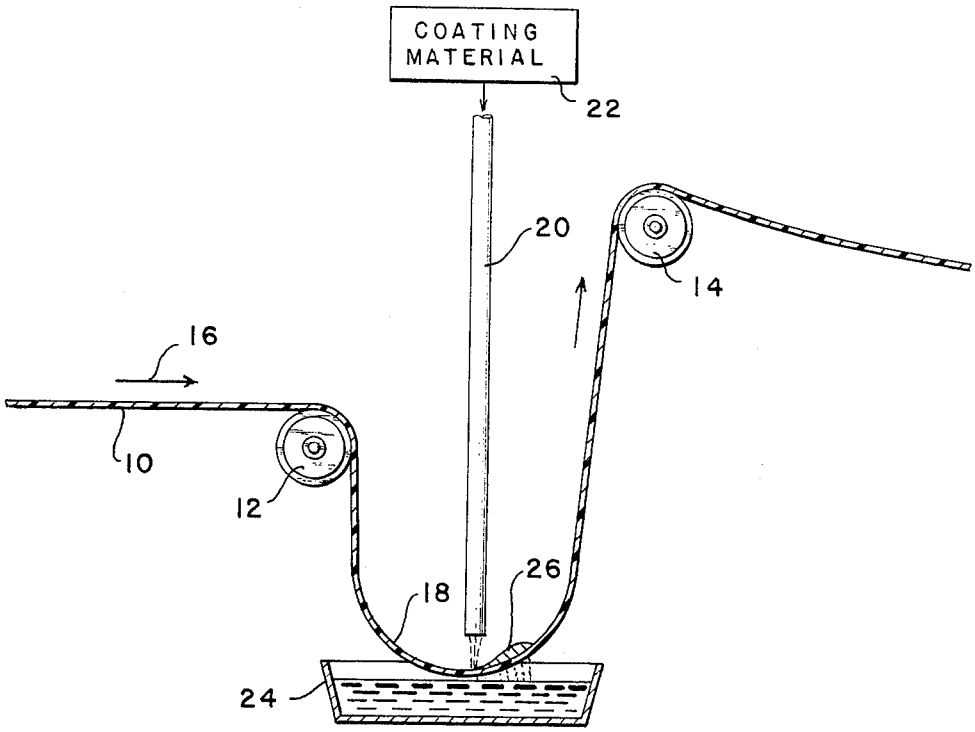
COATING MATERIAL
22
20
14
16
10
12
18
26
24

METHOD FOR CONTINUOUSLY APPLYING A UNIFORM RESINOUS COATING BY PASSING THE SUBSTRATE THROUGH A FREE HANGING LOOP CONTAINING THE COATING COMPOSITION

This invention relates to a method for applying a finished coat to a traveling substrate web. More particularly, this invention relates to a method for continuously applying a polyurethane or similar resin-type surface coating to the wear surface of surface covering materials such as of the type commonly referred to as "vinyl floor covering".

BACKGROUND AND OBJECTS

Floor covering materials have increased in popularity in recent years and are now frequently being manufactured in a variety of decorative appearances for coordination with the decor of the building in which they are installed. Along with increased variety of appearances, is the increased variety of textures available. Quite popular are the embossed floor coverings which have raised areas and depressions. Frequently these embossed floor covering materials have a foam interlayer which also gives a cushioned feel to the floor covering and in many cases even resembles the feel of textile carpets.

Most of the floor coverings now being sold have a surface or wearlayer of a polyester or polyvinyl halide resin such as polyvinyl chloride. Resins such as these are tough and resistant to a large variety of materials which are frequently spilled upon them.

Many of these types of floor coverings having a polyvinyl halide wearlayer also have a clear finish coating applied thereto to give the floor covering material a glossy appearance without the necessity of frequent waxing. This type of finish is applied in a number of ways such as by applying a durable wax to the surface at the time of manufacture or by applying a clear resinous type of finish to the wearlayer. Lacquers were frequently used to provide the gloss finish to the floor covering, however, more recently, polyurethane and polyvinyl chloride coatings have been applied for similar purposes. Such a coating has the advantages of durability and pleasing appearance. The finish coating must of course be clear to enable the multicolored decoration in the wearlayer to show through, and this is the case regardless of whether the surface coating is a lacquer, wax, acrylic, urethane, or other type of coating or polish.

Furthermore, when the surface of the floor covering is of the textured variety, the applied coating must not be so thick as to fill the indentations, for this would destroy the embossed feel and frequently, the embossed appearance, and actually less coating is needed here since less wear occurs in the valleys.

Many ways have been used previously for applying the finish coating to the goods. In the case of a flat surface covering, i.e. one which has not been embossed, a reverse roll coater may be used for applying the coating material. However, for embossed goods, a curtain coater or spray coater is usually used. Because of the nature of the apparatus, however, a curtain coater or spray applicator will tend to fill the indentations of an embossed sheet, and as indicated previously, this is deleterious to the desired product. Also, these types of coating apparatus are expensive and therefore increase the cost of the finished product.

Accordingly, a primary object of this invention is to provide a method for continuously applying a resinous surface coating to a web of floor covering material.

Another object of this invention is to provide a method for applying a polyurethane or polyvinyl chloride surface coating which overcomes the disadvantages of prior art methods.

A further object of this invention is to provide a method for applying a polyurethane or polyvinyl chloride surface coating which is inexpensive to set up and maintain.

Still another object of this invention is to provide a method for continuously applying a polyurethane or polyvinyl chloride surface coating which evenly coats the substrate across its width.

Still a further object of this invention is to provide a method for applying a polyurethane or polyvinyl chloride coating which does not result in filling the embossed areas of the coated substrate.

Yet a further object of this invention is to provide a method for applying a polyurethane or polyvinyl chloride coating which does not result in streaked areas or flow marks in the coating.

These and other objects and advantages of this invention will become apparent when considered in light of the following description and claims when taken together with the accompanying drawing which is a schematic illustration in cross section of an apparatus for carrying out the method of this invention.

In the drawing, the sheet or web 10 of a conventional floor covering material is passed over a first roller 12 and then over a second roller 14 and travels in the direction indicated by the arrow 16. Between the two rolls 12 and 14, the web 10 is allowed to hang in a free loop 18.

Positioned within the loop 18 and opening near the bottom thereof is a supply tube 20 which is in fluid communication with a source 22 of the coating material or resin solution which will be described more fully hereinafter.

Positioned beneath the outside of the loop 18 is a pan 24 which catches the coating material 26 at the sides of the loop.

In operation, the sheet 10 is fed into the loop 18 at a preferable speed of about 15–25 feet per minute. However, other speeds may be used with a concurrent adjustment of the other process parameters. The coating composition is fed into the loop at a rate which just causes a slight overflow at each side of the sheet, so as to obtain a "rolling bank" of the coating material across the entire width of the sheet. If insufficient coating material is supplied, there would be gaps in the coating at the sides of the sheet. If the sheet is particularly wide, two or more laterally spaced supply pipes 20 may be utilized, and in this case, it is necessary that a continuous rolling bank of polyurethane be maintained between the pipes so as to prevent any uncoated areas on the sheet 10.

It has been found that the web traveling upwardly from the bottom of the loop should be at an angle of between about 75° and 90° from horizontal, and preferably between about 85° and 90° and should continue upwardly until draining of the excess is completed, usually about 3–7 feet. After the web 10 passes over the second roll 14, it travels slightly downwardly and preferably at an angle of about 45°. If necessary, the web may pass into a drying oven (not shown) to dry the applied coating by evaporating the solvent therefrom.

Two important factors which are mutually interdependent in the use of this process are the viscosity and the solids content of the resin coating composition. For a polyurethane coating having a dry 2 mil thickness, in order to obtain good even coating without filling the embossed areas and without streaks or flow marks in the coating, it is important that the Brookfield viscosity of the liquid system be about 12–30 cps, and preferably about 20–25 cps. Also, the solids content of the resin solution should be about 15–30% and preferably about 20–30%. A higher viscosity and/or solids content will give a thicker coating which will tend to fill the embossed areas, whereas a lower viscosity and/or solids content will give a thinner coating which would not give a good protection. The coating applied preferably has a thickness of about 0.001–0.005 inch, and desirably, the coating would be about 0.002 inch for most applications. Similarly, for polyvinyl chloride, the viscosity and solids content must be adjusted according to the desired thickness.

The viscosity and solids content of the resin may be adjusted by suitable solvents such as methyl ethyl ketone, tetrahydrofuran, or xylene, or other conventionally used solvents.

The polyurethane resin used is not critical to the process of this invention. It may be either a polyester-type or a polyether-type or may be a mixed polyester-polyether type. Typically, the urethane is supplied in a xylene solution. The resin may be either of the "moisture cure" type which is cured by the moisture contained in the ambient air, or may be the so-called "two package system" which utilizes a catalyst or co-reactant for the curing which is usually accelerated by heat.

In addition to polyurethane, polyvinyl chloride, nitrocellulose, polyvinyl acetate, and other similar resins commonly used for finish coating may be used. Any such resin must be able to be put in solution as a plastisol, organosol, or similar liquid system. The composition is not critical and may be readily formulated by those skilled in the art. The resin, solvent, catalyst, stabilizers, etc., used are selected to provide optimum properties such as toughness, stain resistance, scratch resistance, light stability, adhesion, etc.

If desired, for economy of operation, the resin solution collected by the pan 24 may be returned to the source 22 of the resin and reused in the process. This of course will be dependent upon the extent to which the solvent has evaporated during the processing. However, suitable controls may be used for maintaining the viscosity and solids content within the desired range.

The following non-limiting examples typify the invention of the present method, although the examples deal with polyurethanes, similar results can be obtained with polyvinyl chloride or other resins.

EXAMPLE I

A coating composition having the following formulation is prepared:

| MATERIAL | POUNDS |
|---|---|
| Polyurethane | 100 |
| Methyl ethyl ketone | 38.3 |
| Tetrahydrofuran | 38.4 |
| Catalyst | 3.3 |
| Total | 180.0 |

The resin as supplied had an as-purchased solids content of 33%. The same resin formulation without the additional solvents was initially tried at this 33% solids content. The speed of the web was 18–20 feet per minute and the angle of climb out of the loop was approximately 90°. The time of climb was 15–20 seconds. The initial Brookfield viscosity of the resin mixture at 20 rpm was 30 cps. The resultant coating was slightly thicker than the optimal 0.002 inch, but was otherwise satisfactory.

The solvents were then added to the same resin formulation in the amounts indicated above and the viscosity of the solution was thereby reduced to 12 cps and 16% urethane resins solids. The coating produced by this formulation gave a slight appearance of "crawl" in the coating which was otherwise uniformally applied across the width of the sheet.

EXAMPLE II

A urethane resin solution having the following composition was prepared:

| MATERIAL | POUNDS |
|---|---|
| Polyurethane (33% solids) | 100 |
| Methyl ethyl ketone | 59.6 |
| Tetrahydrofuran | 59.6 |
| Catalyst | 3.3 |
| Total | 222.5 |

This formulation had a Brookfield viscosity at 20 rpm of 20 cps and a 27% solids content. The line speed was 18 feet per minute and the angle of climb approximately 90° with the time of climb being approximately 20 seconds. This formulation gave a thickness of 2 mils and an even coating.

EXAMPLE III

| MATERIAL | POUNDS |
|---|---|
| Polyurethane (33% solids) | 16.7 |
| Solvent | 19.9 |
| Catalyst | .48 |
| Total | 37.08 |

The example was run in two stages. The first stage used methyl ethyl ketone as the solvent and had a Brookfield viscosity at 20 rpm of 20 cps, and gave a coating thickness of 5 to 6 mils. The second stage used xylene as the solvent and had a Brookfield viscosity at 20 rpm of 25 cps, and gave a coating thickness of 2.6 to 3.3 mils. In both cases, the line speed was 18 feet per minute and the angle of climb was approximately 75°–80°. The height of climb from the loop was 6.5 feet and the time of climb was approximately 20 seconds.

Thus, the batch using methyl ethyl ketone as a solvent gave a coating having a dry film thickness approximately double that of the material using the xylene as the solvent. The results indicated that solvent selection, in addition to height and angle of climb can be used to control the coating thickness applied. Generally, a more volatile solvent will give a thicker coating due to the higher rate of evaporation causing a more rapid increase in viscosity of the solution.

EXAMPLE IV

The following formulation of the resin solution was prepared:

| MATERIAL | POUNDS |
|---|---|
| Polyurethane (40% solids) | 190 |
| Polyurethane (35% solids) | 17.2 |
| Xylene | 10 |
| Catalyst | 12 |
| Total | 229.2 |

The Brookfield viscosity of this solution at 20 rpm was 30 cps. The sheet material was run through the loop at a speed of 16 feet per minute, and a height of climb of 8 feet at 80°–90° was used. The coating applied in this manner had a thickness of 2.2–2.5 mils.

EXAMPLE V

The following urethane formulation was prepared:

| MATERIAL | POUNDS |
|---|---|
| Polyurethane (35% solids) | 200 |
| Xylene | 139 |
| Catalyst | 8.4 |
| Total | 347.4 |

This material had a Brookfield viscosity at 20 rpm of 20 cps and a 20% urethane resin solids content. The speed of the sheet material through the loop was approximately 20 feet per minute and had an angle of climb out of the loop of approximately 90° and an angle of descent toward the drying oven of approximately 45°. The time of climb was approximately 1 minute. The feeding rate of the urethane solution was such as to allow only a minimum overflow at the ends of the sheet, and a satisfactory coated surface having an acceptably even coating thickness of the lands, where the wear is the greatest, was attained. In the valleys, contrary to what would be expected, a thinner coating was applied. This is not possible with conventional coating processes without expensive controls and sophisticated apparatus.

As indicated previously, the particular urethane or polyvinyl chloride resin utilized in this invention is not critical, and is usually selected for the physical and esthetic properties which it imparts to the final product.

In a series of 16 different thickness measurements on a coated sample, the thickness of the coating is found to vary but slightly across the width of the product in the raised areas or in the valleys. The center of the sheet averaged a thickness of 2.0 mils of coating while the edges averaged 2.0 mils and 1.8 mils.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A method for continuously applying a resin surface coating to a traveling substrate web consisting essentially of:

a. moving said web into a free hanging loop, b. continuously feeding a liquid resin containing composition into said loop at a rate so as to maintain at least a slight overflow of said composition at the sides of the loop and to maintain a continuous rolling bank of said composition across the width of said web at the lower portion of said loop, c. withdrawing said web upwardly from said loop so that excess coating material on the web drains back downwardly into the loop and d. heating the coated substrate for drying the coating.

2. A method as in claim 1 and including:
withdrawing said web from said loop at an angle of between about 75° and 90° from horizontal.

3. A method as in claim 1 and wherein:
said coating material has a Brookfield viscosity of about 12–30 cps.

4. A method as in claim 3 and wherein:
said coating material has a Brookfield viscosity of about 20–25 cps.

5. A method as in claim 1 and including:
moving said web at a rate of between about 10 and 25 feet per minute.

6. A method as in claim 5 and including:
moving said web at a rate of about 16–20 feet per minute.

7. A method as in claim 2 and including:
withdrawing said web through a vertical rise of at least 4.5 feet.

8. A method as in claim 1 and wherein:
said coating composition has a solids content of about 15 to 30%.

9. A method as in claim 2 and wherein:

a. said coating composition has a Brookfield viscosity of about 20–25 cps and a solids content of about 20 to 30%, and b. withdrawing said web through a vertical rise of at least 4.5 feet at a rate of about 16–20 feet per minute.

10. A method as in claim 9 and wherein:
said coating has a thickness of about 0.002 inch.

11. A method as in claim 1 and wherein:
said web has an embossed surface.

12. A method as in claim 1 and including:

a. collecting said overflow of coating composition, and b. refeeding the collected overflow to said loop.

13. A method as in claim 11 and including:
passing the withdrawn coated web over a roller and downwardly at an angle of about 45°.

14. A method as in claim 1 and wherein:
said resin containing composition is a solution of a polyurethane in a solvent.

15. A method as in claim 11 and wherein:
said dried surface coating is thicker in the raised areas than in the depressed areas.

16. A method as in claim 1 and wherein:

a. said web has raised areas and depressed areas, and b. said surface coating is thicker in the raised areas than in the depressed areas.

17. A method as in claim 1 and wherein:
said resin containing composition is a solution of a resin in a solvent.

18. A method as in claim 1 and including:
continuously maintaining said loop while moving said web therethrough.

19. A method as in claim 1 and including:
controlling the thickness of the applied coating by controlling the viscosity and solids content of said composition.

20. A product produced by the method of claim 16.

* * * * *